US007416219B2

(12) United States Patent
Sato et al.

(10) Patent No.: US 7,416,219 B2
(45) Date of Patent: Aug. 26, 2008

(54) SWIVELING WORK MACHINE

(75) Inventors: Fumiki Sato, Sakai (JP); Shizuo Shimoie, Sakai (JP); Yoshihiro Kato, Wakayama (JP); Takanori Matsumoto, Sakai (JP); Kenzo Koga, Izumi (JP)

(73) Assignee: Kubota Corporation, Osaka (JP)

( * ) Notice: Subject to any disclaimer, the term of this patent is extended or adjusted under 35 U.S.C. 154(b) by 389 days.

(21) Appl. No.: 11/225,811

(22) Filed: Sep. 13, 2005

(65) Prior Publication Data

US 2006/0108309 A1 May 25, 2006

(30) Foreign Application Priority Data

Nov. 22, 2004 (JP) ..... 2004-337988

(51) Int. Cl.
*B60P 3/22* (2006.01)

(52) U.S. Cl. ..... 280/830; 180/9.44; 220/562; 220/563; 220/564; 280/831; 280/832; 280/833

(58) Field of Classification Search ..... 280/830–834; 180/9.44; 220/562–564; 212/232
See application file for complete search history.

(56) References Cited

U.S. PATENT DOCUMENTS 5,791,301 A * 8/1998 Watanabe ..... 123/41.31
6,009,643 A * 1/2000 Maeba et al. ..... 37/443
6,135,223 A * 10/2000 Miyachi et al. ..... 180/69.21
2003/0110669 A1 * 6/2003 Watanabe et al. ..... 37/466

FOREIGN PATENT DOCUMENTS

| | | | | |
|---|---|---|---|---|
| EP | 0 807 719 | A1 | | 11/1997 |
| EP | 0 807 720 | A1 | | 11/1997 |
| EP | 0807719 | A1 | | 11/1997 |
| EP | 807719 | A1 | * | 11/1997 |
| EP | 0807720 | A1 | | 11/1997 |
| EP | 0 816 575 | A2 | | 1/1998 |
| EP | 816575 | A2 | * | 1/1998 |
| EP | 0816575 | A2 | | 1/1998 |
| EP | 0 971 077 | A1 | | 1/2000 |
| EP | 0971077 | A1 | | 1/2000 |
| JP | 06 136789 | A | | 5/1994 |
| JP | 06136789 | A | | 5/1994 |
| JP | 10-331196 | | | 6/1997 |
| JP | 10 331196 | A | | 12/1998 |
| JP | 10331196 | A | * | 12/1998 |
| JP | 2003 064723 | A | | 3/2003 |
| JP | 2003064723 | A | | 3/2003 |

* cited by examiner

*Primary Examiner*—Lesley D. Morris
*Assistant Examiner*—Michael R Stabley
(74) *Attorney, Agent, or Firm*—The Webb Law Firm

(57) ABSTRACT

A swiveling work machine includes a swivel deck mounted to be pivotable about a vertical axis and a side cover for covering one lateral side on the swivel deck, an accommodating space capable of accommodating a work machine accessory being provided inside the lateral cover. The accommodating space accommodates, as the implement accessory, a work oil tank, a fuel tank and a control valve unit. The work oil tank is disposed at a fore-and-aft intermediate portion on one lateral side on the swivel deck. The fuel tank is disposed forwardly of the work oil tank with forming a gap relative thereto. The control valve unit is disposed upwardly of the fuel tank and longitudinally along the fore/aft direction.

5 Claims, 12 Drawing Sheets

SWIVELING WORK MACHINE

BACKGROUND OF THE INVENTION

1. Field of the Invention

The present invention relates to a swiveling work machine such as a backhoe.

2. Description of the Related Art

Conventionally, in a swiveling work machine such as a backhoe, a swivel deck is mounted on a self-propelling machine body to be pivotable about a vertical axis. The swivel deck mounts, at a rear region thereof, such components as an engine, a radiator, a hydraulic pump, etc., which are all covered with a hood. The swivel deck includes also, at one of right and left regions thereof, an accommodating space for disposing work machine accessories such as a fuel tank, a work oil tank, a battery, a control valve unit, etc. and this accommodating space is covered with a side cover which extends from a front portion of the hood toward a front region of the swivel deck. The swivel deck further mounts, at the other of the right and left regions thereof, a driver's seat and between this driver's seat and the accommodating space, an excavator is mounted as an example of implement.

In connection with the above, in the case of a backhoe construction disclosed by JP-A-10-331196 wherein the above-described work machine accessories are disposed one of right and left regions on the swivel deck, a work oil tank is disposed at a fore-and-aft intermediate portion on the right side region of the swivel deck which corresponds the region forwardly of a radiator, a fuel tank is disposed forwardly of this work oil tank and a battery is disposed at a region of the swivel deck outwardly of the work oil tank.

Looking at the layout of the above-described work machine accessories on the swivel deck from the viewpoint of maintenance thereof, it is preferred that the work oil tank and the control valve unit which require periodical checks and maintenance and the fuel tank, the battery and the radiator which require water or oil supply be disposed on a same side on the swivel deck and the hood covering these components be adapted to be openable/closable.

However, in the case of the conventional backhoe disclosed in the above-cited document, the control valve unit is not disposed at the right side region on the swivel deck where the work oil tank, the fuel tank and the battery are disposed and no space allowing disposal of the control valve unit is provided, either. Further, in the case of this conventional backhoe, the front face of the work oil tank is placed in opposition, over substantially entire area thereof, to the fuel tank, so that the fuel tank tends to be subjected to undesirable influence of heat from the work oil tank.

SUMMARY OF THE INVENTION

In view of the above-described state of the art, a primary object of the present invention is to provide a swiveling work machine which allows easy maintenance of a control valve unit even when this control valve unit is disposed on the same right or left side on the swivel deck as the fuel tank and the battery and which can also restrict disadvantageous influence of heat from the work oil tank to the fuel tank.

For accomplishing the above-noted object, according to the present invention, there is proposed a swiveling work machine comprising:

a swivel deck mounted to be pivotable about a vertical axis; and a side cover for covering one lateral side on the swivel deck, an accommodating space capable of accommodating a work machine accessory being provided inside said lateral cover;

wherein said accommodating space accommodates, as said implement accessory, a work oil tank, a fuel tank and a control valve unit; and said work oil tank is disposed at a fore-and-aft intermediate portion on one lateral side on said swivel deck, said fuel tank is disposed forwardly of said work oil tank with forming a gap relative thereto, and said control valve unit is disposed upwardly of said fuel tank and longitudinally along the fore/aft direction.

With the above construction, the gap formed between the work oil tank and the fuel tank can effectively restrict adverse influence of heat from the work oil tank to the fuel tank.

Further, as the control valve unit is disposed upwardly of the fuel tank, this control valve unit is disposed upwardly of the accommodating space also. Hence, an operator can carry out a maintenance operation on the control valve under his/her stable posture (e.g. standing erect posture).

According to one preferred embodiment of the invention, in the above-described construction, said gap accommodates a battery therein, and said control valve unit is disposed upwardly of the battery and the fuel tank.

According to one preferred embodiment, said battery and said control valve unit are supported to a support frame fixed to said swivel deck, and said support frame includes a pair of stays disposed erect on an upper face of the swivel deck at positions forwardly and rearwardly of the battery, a first plate mounted between vertical intermediate portions of the pair of stays and mounting the battery thereon, and a second plate connected to upper ends of the pair of stays and mounting the control valve unit thereon.

With the above-described construction, the battery is supported to the swivel deck via the first plate and the pair of stays of the support frame and the control valve unit is supported to the swivel deck via the second plate and the pair of stays of the support frame. Therefore, these components, i.e. the battery and the control valve unit, are accommodated within the accommodating space while being supported to the swivel deck via the support frame. Moreover, the pair of stays are connected together at their vertical intermediate portions by means of the first plate and connected together also at their upper ends by means of the second plate, so that the support frame is constructed in the form of a grating having high strength. Further, downwardly of the battery, there is formed a space surrounded by the pair of stays and the first plate, so that the battery and other work machine accessories which require occasional replacement can be accommodated within this space.

According to one preferred embodiment of the present invention, a front portion of the second plate extends to a position upwardly of the fuel tank. With this construction, the battery and the fuel tank are covered by the second plate which mounts the control valve unit thereon. Hence, there is no possibility of splashing of oil during a maintenance operation of the control valve unit onto the battery or the fuel tank, so that a cleaning operation of these components, i.e. the work oil tank, the fuel tank, the battery and the control valve unit can be carried out easily. Moreover, the second plate can serve also to effectively shield the influence of heat from the control vale to the fuel tank.

According to one preferred embodiment of the present invention, at least one of a front lower portion of the work oil tank and a rear portion of the fuel tank extends into a portion of said gap on the inner side of the swivel deck than the battery. With this construction, the work oil tank and the fuel tank are placed in opposition to each other only at their portions extending into the gap. Hence, this construction can minimize the influence of heat from the work oil tank to the fuel tank. In addition, the work oil tank and/or the fuel tank can be formed larger advantageously, without enlarging the accommodating space. As a result, the gap can be utilized even more efficiently. Moreover, as the battery is disposed on the outer side of the swivel deck, this construction is advantageous also for facilitating e.g. the maintenance of this battery.

Further and other features and advantages of the invention will become apparent upon reading the following detailed description of the preferred embodiments thereof with reference to the accompanying drawings.

DESCRIPTION OF THE PREFERRED EMBODIMENTS

Next, with reference to the accompanying drawings, preferred embodiments of the present invention will be described in details, with taking a backhoe as an example of a swiveling work machine.

In the following discussion, a direction along which the backhoe travels forward or rearward without steering will be referred to as a fore/aft direction, a direction orthogonal to this fore/aft direction will be referred to as right/left direction, and a direction orthogonal to both the fore/aft direction and the right/left direction will be referred to as a vertical direction, respectively.

Figure 1:
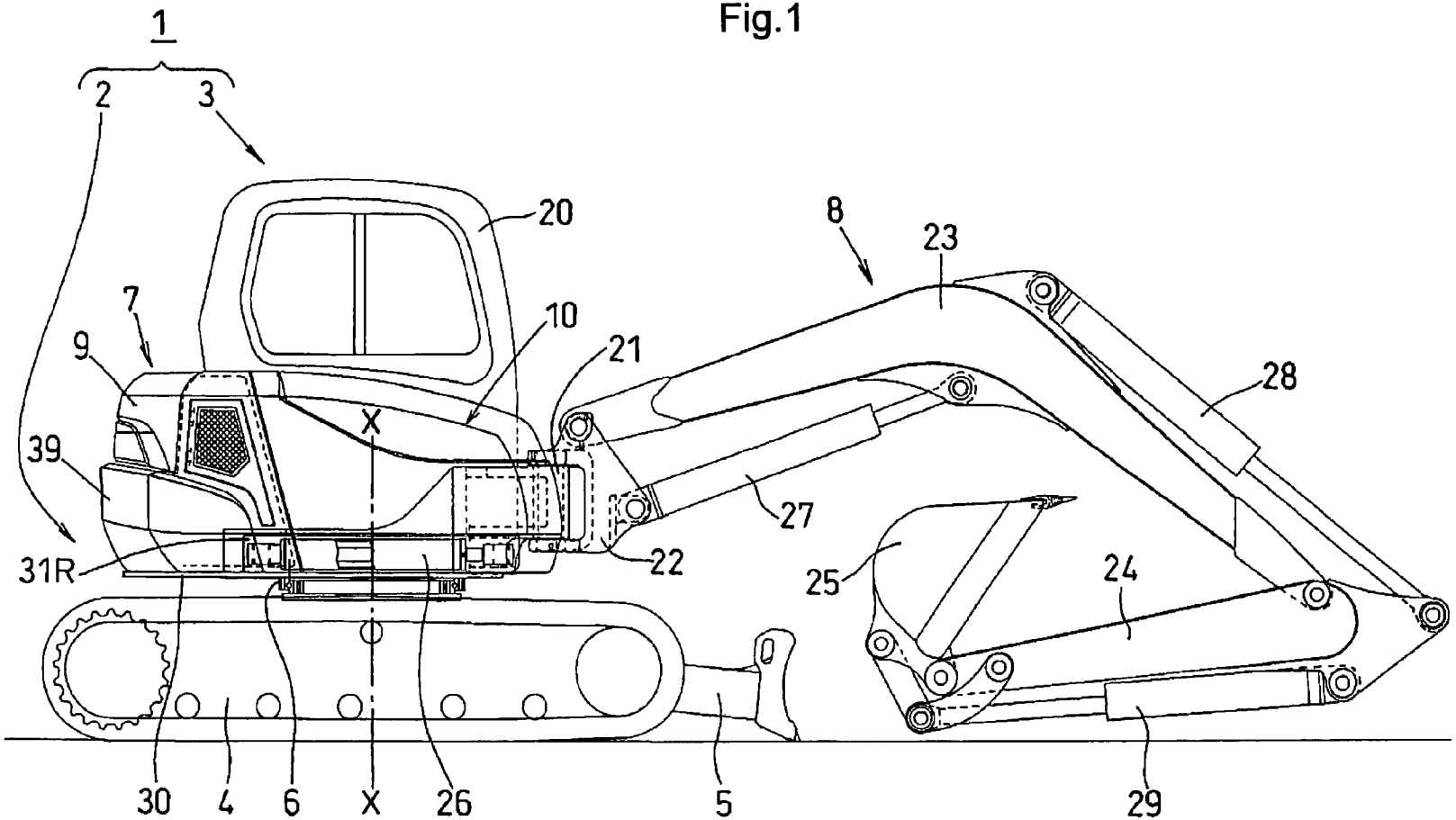
FIG. 1 is an overall right side view of a backhoe showing as an example of a swiveling work machine according the invention.

As shown in FIG. 1, the backhoe 1 relating to the present invention is comprised mainly of a traveling unit 2 disposed at a lower section of the backhoe and a swivel body 3 disposed at an upper section of the same.

The traveling unit 2 comprises a crawler type traveling unit including a pair of right and left traveling devices 4 each having an endless crawler belt made of rubber or metal and being driven by a traveling motor M. Further, at the front of the traveling unit 2, a dozer 5 is mounted.

The swivel body 3 includes a swivel deck 7 which is mounted on the traveling unit 2 via a swivel bearing 6 to be pivotable to the right or left about a vertical swivel axis X. Forwardly of this swivel deck 7, there is mounted an excavator 8 for effecting an excavating operation.

Further, a rear upper region of the swivel deck 7 is covered with a hood 9 and an area above either right or left side (the right side in this embodiment) of the swivel deck is covered with a side cover 10 extending substantially flush from the hood 9. With this, from the right region to the rear region of the swivel deck 7, there is formed an accommodating space S for accommodating work machine accessories shown in FIG. 2 such as an engine 11, a radiator 12, a hydraulic pump 13, a fuel tank 14, a work oil tank 15, a battery 16, a control valve unit 17, etc.

Incidentally, in the instant embodiment, of the accommodating space S, the portion thereof covered with the hood 9 is provided as an engine room S1 and the further portion thereof covered with the side cover 10 is provided as a tank room (accommodating space) S2, respectively.

Further, on either right or left (the left side in this embodiment) on the swivel deck 7, there is mounted a cabin 20 covering a driver's cab housing a seat 19 and a driving section.

The swivel deck 7 includes a support bracket 21 in the form of a projection projecting from a forward right/left center portion therewith with a slight offset to the right side. And, to this support bracket 21, the excavator 8 shown in FIG. 1 is attached.

The excavator 8 includes a swing bracket 22 supported to the support bracket 21 to be pivotable to the right or left about a vertical axis, a boom 23 having its base portion pivotally connected to the swing bracket 22 to be vertically pivotable about a right/left axis, an arm 24 pivotally connected to a leading end of the boom 22 to be pivotable in the fore/aft direction about a right/left axis, and a bucket 25 pivotally connected to the leading end of the arm 24 to be pivotable about a right/left axis.

The swing bracket 22 is pivoted in association with an expansion/contraction of a swing cylinder 26 which is disposed on the right side within the horizontal extension of the swivel deck 7.

The boom 23 is pivoted in association with an expansion/contraction of a boom cylinder 27 interposed between this boom 23 and the swing bracket 22. The arm 24 is pivoted in association with an expansion/contraction of an arm cylinder 28 interposed between this arm 24 and the boom 23. The bucket 25 is pivoted in association with an expansion/contraction of a bucket cylinder 29 interposed between this bucket 25 and the arm 24. The swing cylinder 26, the boom cylinder 27, the arm cylinder 28 and the bucket cylinder 29 all comprise hydraulic cylinders (hydraulic components).

Figure 4:
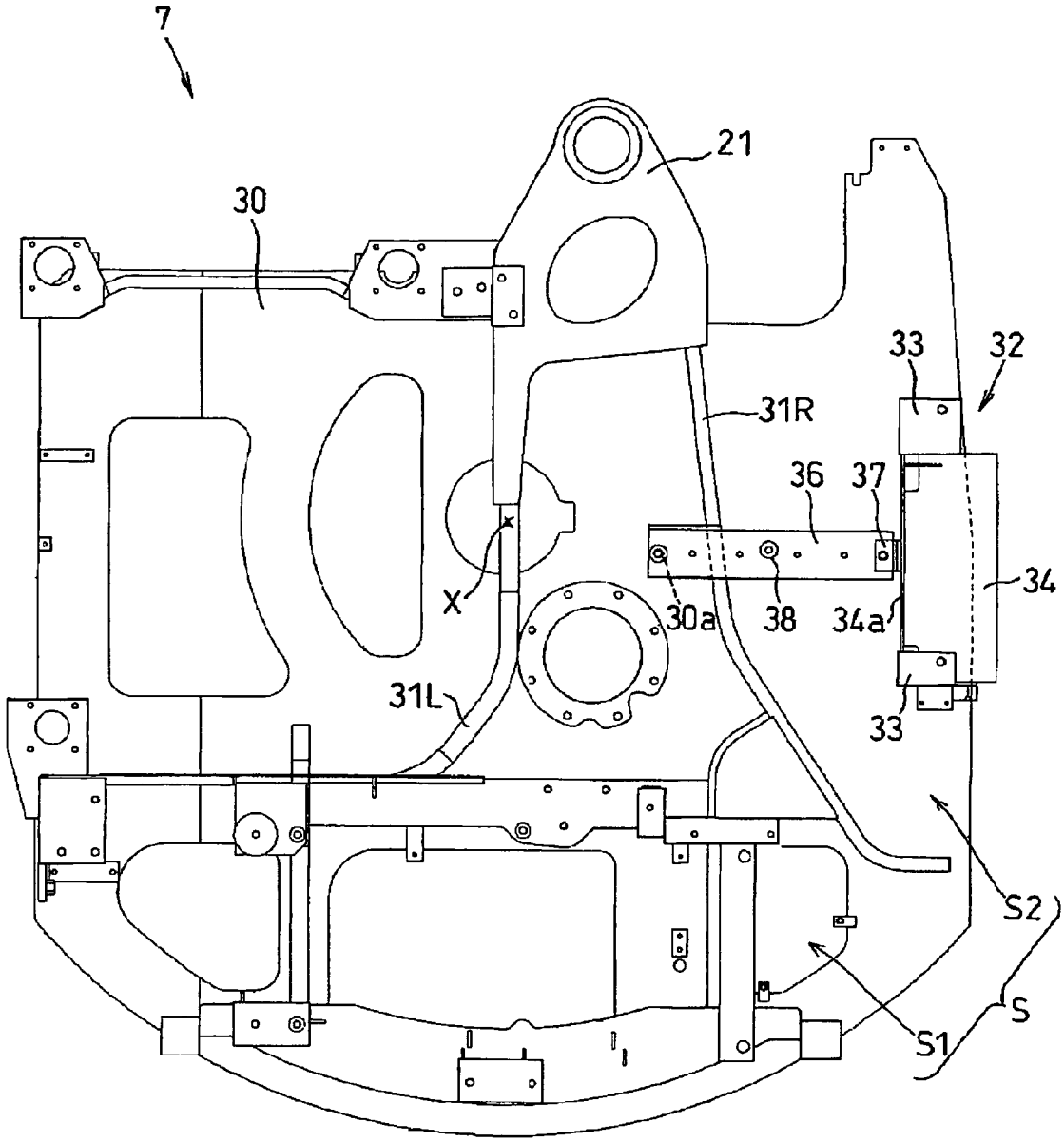
FIG. 4 is a plan view of a swivel base plate of the backhoe.

Further, the swivel deck 7 includes a swivel base plate 30 comprised of a thick plate connected to the swivel bearing 6. As shown in FIG. 4, on this swivel base plate 30, there are fixed, by means of e.g. welding, a pair of left and right vertical ribs 31R, 31L extending at the right/left intermediate portion from the front region to the rear region. And, there is also fixed, by means of fasteners such as bolts, a support frame 32 for supporting work machine accessories to be housed within the tank room S2. On this swivel base plate 30, there are fixed also other members such as reinforcing members, brackets, stays, etc. for mounting various components. These members, i.e. the vertical ribs 31L, 31R, the support frame 32, the reinforcing members, the brackets, the stays, etc. together constitute a swivel frame.

Figure 3:
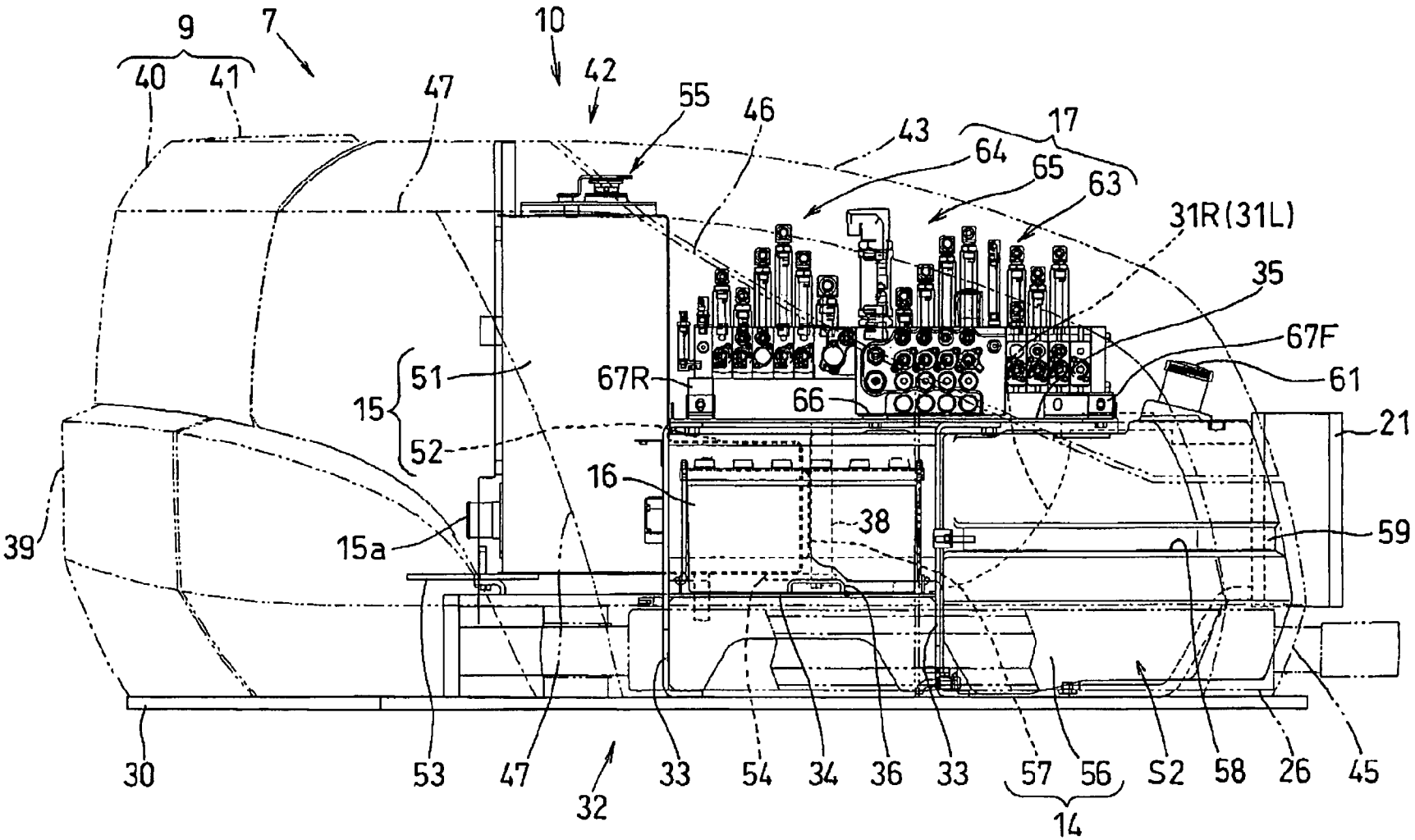
FIG. 3 is a right side view of the backhoe.

The left and right pair of vertical ribs 31L, 31R extend, at their front ends, forwardly beyond the swivel base plate 30, and between these front ends, the support bracket 21 is fixedly attached. Further, as shown in FIG. 3, the front portions of these vertical ribs 31L, 31R are formed vertically high and their rear portions are formed vertically low.

The left vertical rib 31L, as shown in FIG. 4, extends past a swiveling or rotational center or axis X of the swivel body 3 in the fore/aft direction and extends above the swivel base plate 30 rearward from its front side. Further, the rib 31L is bent, at a position rearwardly of the rotational axis X, toward the outer side (toward the left side in this embodiment) of the swivel base plate 30 in the right/let direction. And, the rear portion of this left vertical rib 31L extends along the rear lower portion of the cabin 20.

Also, the right vertical rib 31R is bent from a position with a slight offset toward the right side in the right/left direction of the front of the swivel base plate 30 toward the right rear portion of the swivel base plate 30.

Further, as shown in FIG. 1, the front end of the swing cylinder 26 is connected to the swing bracket 22 and the rear end of the swing cylinder 26 is connected to the swivel base plate 30 in the vicinity of the rear end of the right vertical rib 31R.

Figure 5:
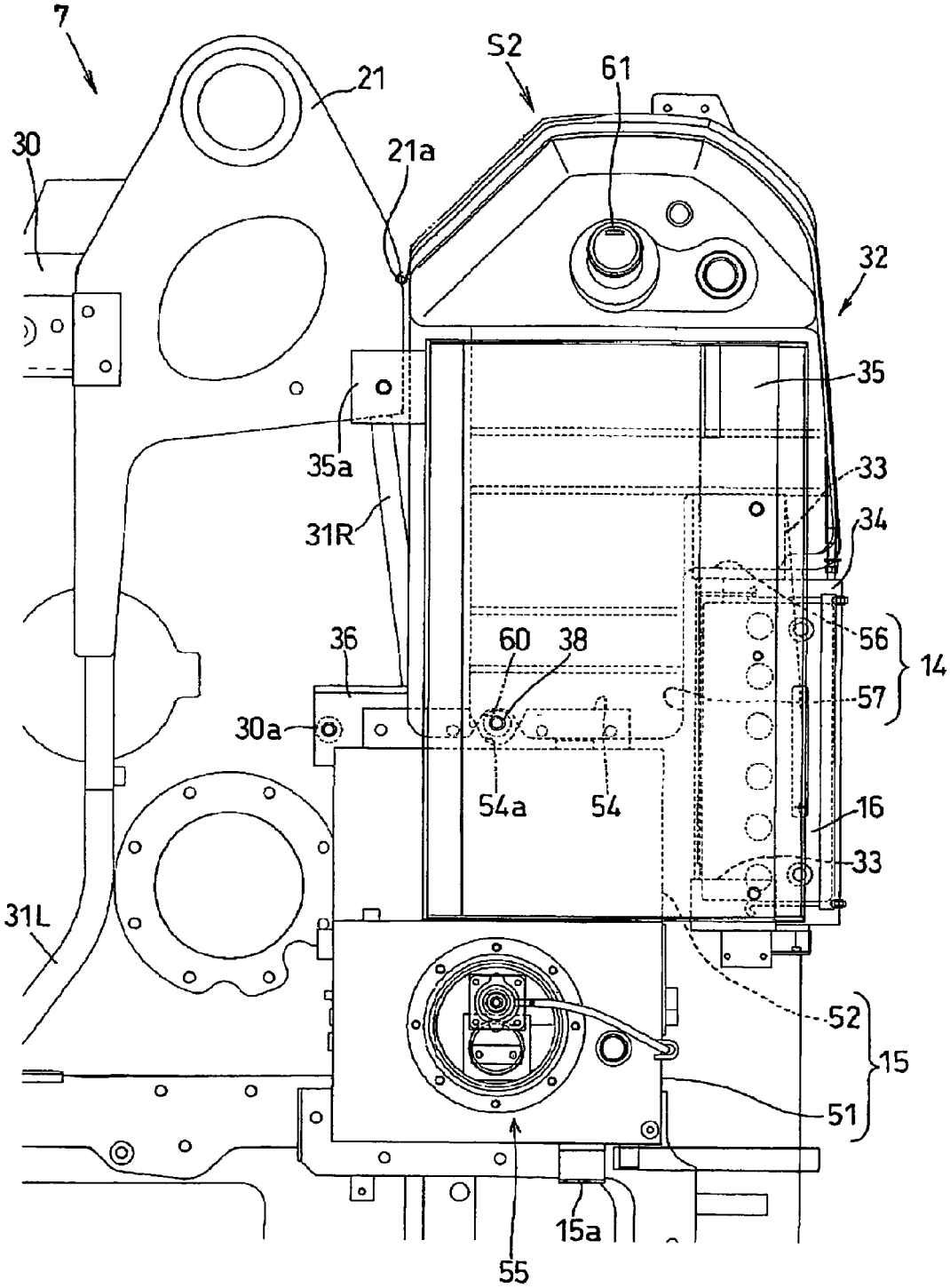
FIG. 5 is a plan view showing a layout of a fuel tank and a work oil tank.

The support frame 32, as shown in FIGS. 3-5, is disposed along the right side of the swivel deck 7 and at a position opposed to a fore/aft intermediate portion of the right vertical rib 31R.

This support frame 32 includes a pair of fore and aft stays 33, 33 each having an angular hooked shape as seen sidewise and vertically extending on the swivel base plate 30, a first plate 34 mounted to vertical intermediate portions between the fore and aft stays 33, 33, and a second plate 35 connected to upper ends of the pair of fore and aft stays 33, 33. And, lower ends of the pair of fore and aft stays 33, 33 are secured to the swivel base plate 30.

As shown in FIG. 4, the first plate 34 includes, at its end located on the inner side of the swivel deck, a bent portion 34*a* which is bent upward and its end located on the outer side of the swivel deck projects slightly outward from the swivel base plate 30 in the plan view.

Further, as shown in FIG. 5, the second plate 35 has a rectangular shape which is longitudinal along the fore/aft direction of the swivel deck 7. This plate 35 includes, at a left front portion thereof, a tongue 35*a* projecting to the inner side of the swivel deck. Further, the left center portion and the rear portion of the plate 35 are connected to the pair of stays 33, 33 by means of fasteners such as bolts, and the tongue 35*a* is connected, via a fastener such as a bolt, to the rear end of the upper face of the support bracket 21.

Also, as shown in FIG. 4, the support frame 32 includes a bridge 36 extending across and between the bent portion 34*a* of the first plate 34 and the right vertical rib 31R. This bridge 36, as shown in FIG. 3, has a reversed U-shaped cross section and has one end located on the outer side of the swivel deck fixed to the bent portion 34*a* of the first plate 34 through a bracket 37 shown in FIG. 4. Whereas, the other end located on the inner side of the swivel deck extends past above the right vertical rib 31R toward the center of the swivel deck, with its leading end being placed in opposition to a boss-like member 30*a* projecting from the swivel base plate 30 and secured to this boss-like member 30*a* via a fastener such as a bolt.

Further, at the right/left center of the bridge 36, there is disposed a cylindrical member 38 extending toward the second plate 35, with an upper end of the cylindrical member 38 being connected to the second plate 35 via a fastener such as a bolt. With this, the second plate 35, as shown in FIG. 5, is supported at the four positions of the pair of stays 33, 33, the support bracket 21 and the cylindrical member 38, and the support frame 32 is supported on the swivel base plate 30 at the five positions of the pair of stays 33, 33, the connection to the swivel base plate 30, the support bracket 21, the right vertical rib 31R and the boss-like member 31*a*. Hence, the support frame 32, including the second plate 35, is firmly fixed on the swivel base plate 30.

Figure 2:
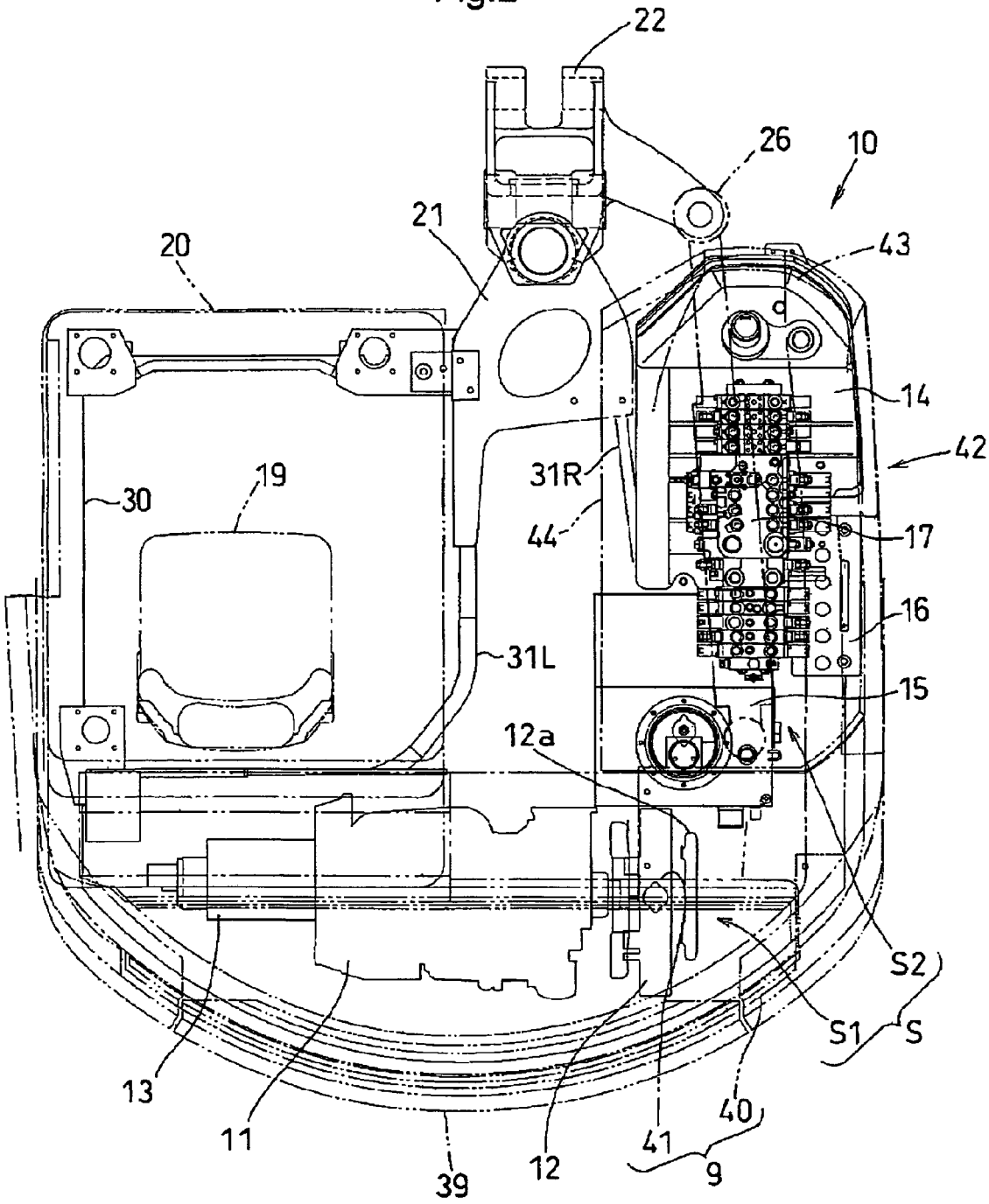
FIG. 2 is a plan view showing an entire swivel deck of the backhoe.

Further, as shown in FIG. 2 and FIG. 3, at a rear region of the swivel base plate 30, there is mounted a counter weight 39 which is disposed on the opposed lateral rear sides and the rear side of this swivel base plate 30 and constitutes a rear portion of the swivel deck 7 and which also provides a weight balance relative to the excavator 8. This counter weight 39 includes an edge projecting upwardly of the swivel base plate 30, which edge is placed in opposition to the lower edges of the hood 9 and the side cover 10.

Therefore, the accommodating space S is covered with not only the hood 9 and the side cover 10, but also the counter weight 39. As a result, when the backhoe 1 travels (forward or reverse) or the swivel body 3 is swiveled, collision or contact between the work machine accessories housed within the accommodating space S with obstacles (wall, plant, etc.) can be avoided as much as possible. Further, undesirable diffusing of noise such as noise from the engine 11 to the ambience can be prevented, and deterioration of heat environment of the driving components can be prevented as well.

The hood 9 is formed by sheet metal working, resin molding, etc. As shown in FIG. 2, this hood comprises an assembly of a rear hood 40 which is openable and closable to cover the engine room S1 from an area rearwardly of the swivel deck to its upper area and a front hood 41 which includes edges opposed to the front edge and opposed lateral edges of the rear hood 40 and covers the area above the engine room S1, with the front and rear hoods 41, 40 being detachable from each other. Further, the rear hood 40 and the counter weight 39 can respectively be released from locked positions thereof by means of locking means.

Figure 7:
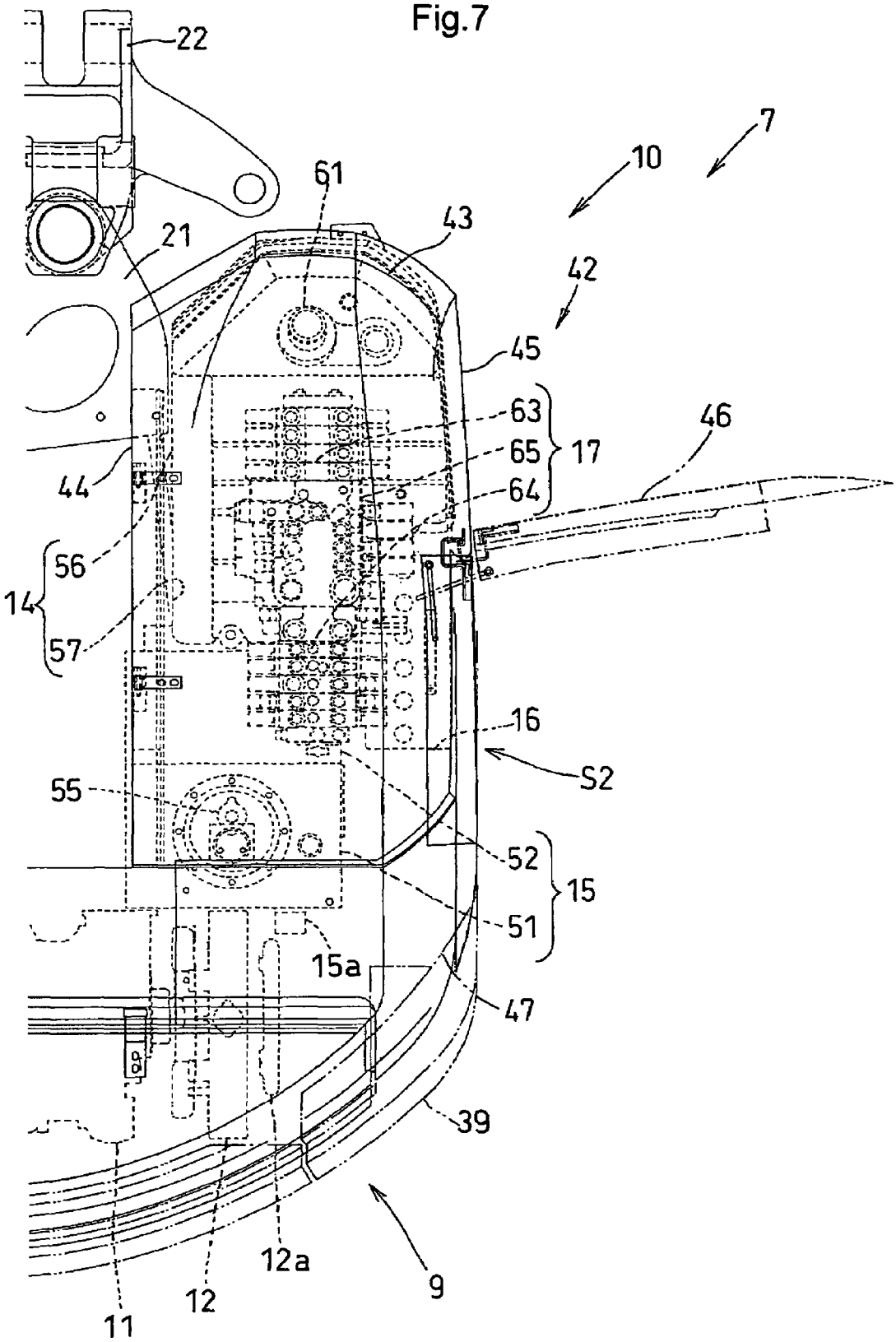
FIG. 7 is a plan view of an opening/closing cover member.
Figure 8:
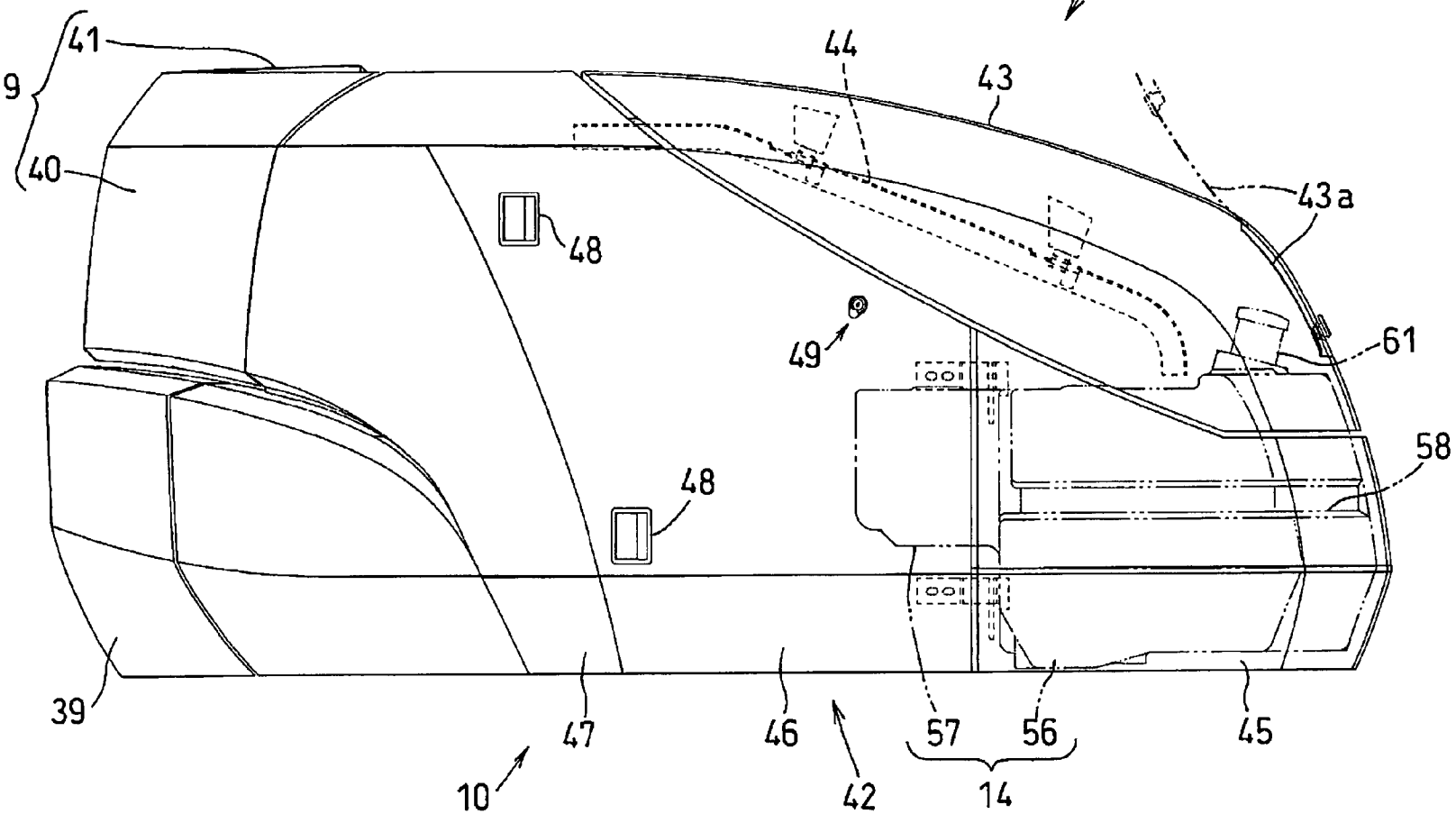
FIG. 8 is a right side view of the opening/closing cover member.

As shown in FIGS. 3, 7 and 8, the side cover 10 includes a cover body 42 covering the tank room S2 from the outer side of the swivel deck, a cover lid 43 pivoted to an upper portion of the cover body 42 to be opened/closed and adapted for covering the tank room S2 from above, and a cover inner wall 44 pivotally supporting the cover lid 43 for opening/closing this and adapted for covering the swivel deck inner side of the tank room S2.

Further, the cover body 42 includes a front fixed cover member 45 fixed to the swivel base plate 30 for covering the tank room S2 from a front lateral side to a right front side thereof, an openable/closable cover member 46 supported to the front fixed cover member 45 to be pivotable about a vertical axis, and a rear fixed cover member 47 fixed to the swivel base plate 30 for covering a right rear side of the tank room S2.

Referring to the openable/closable cover member 46, under its closed condition, its rear edge (rear line) is placed in opposition to the front edge (front line) of the rear fixed cover member 47 and its upper edge (upper line) is placed in opposition to the lateral lower edge (lateral line) of the cover lid 43. With this, when the openable/closable cover 46 and the cover lid 43 are opened, the tank room S2 is exposed from its upper portion to its right portion.

Further, as shown in FIG. 8, in the portion of the outer face of the openable/closable cover member 46, there are formed a pair of upper and lower grip portions 48, 48 in the form of recesses. And, the cover lid 43 and the openable/closable cover member 46 can be locked and released by means of a lock mechanism 49 disposed across and between opposed faces of the cover lid 43 and the openable/closable cover member 46.

As shown in FIG. 2, inside the engine room S1, the engine 11 is mounted on the swivel base plate 30, with its crank shaft being oriented along the right/left direction. On one of left and right (the right side in this embodiment) of the engine 11, the radiator 12 is disposed. And, on the swivel deck outer side of this radiator 12, an oil cooler 12*a* is disposed. Further, on the other of left and right (the left side in this embodiment) of the engine 11, the hydraulic pump 13 is disposed.

Figure 6:
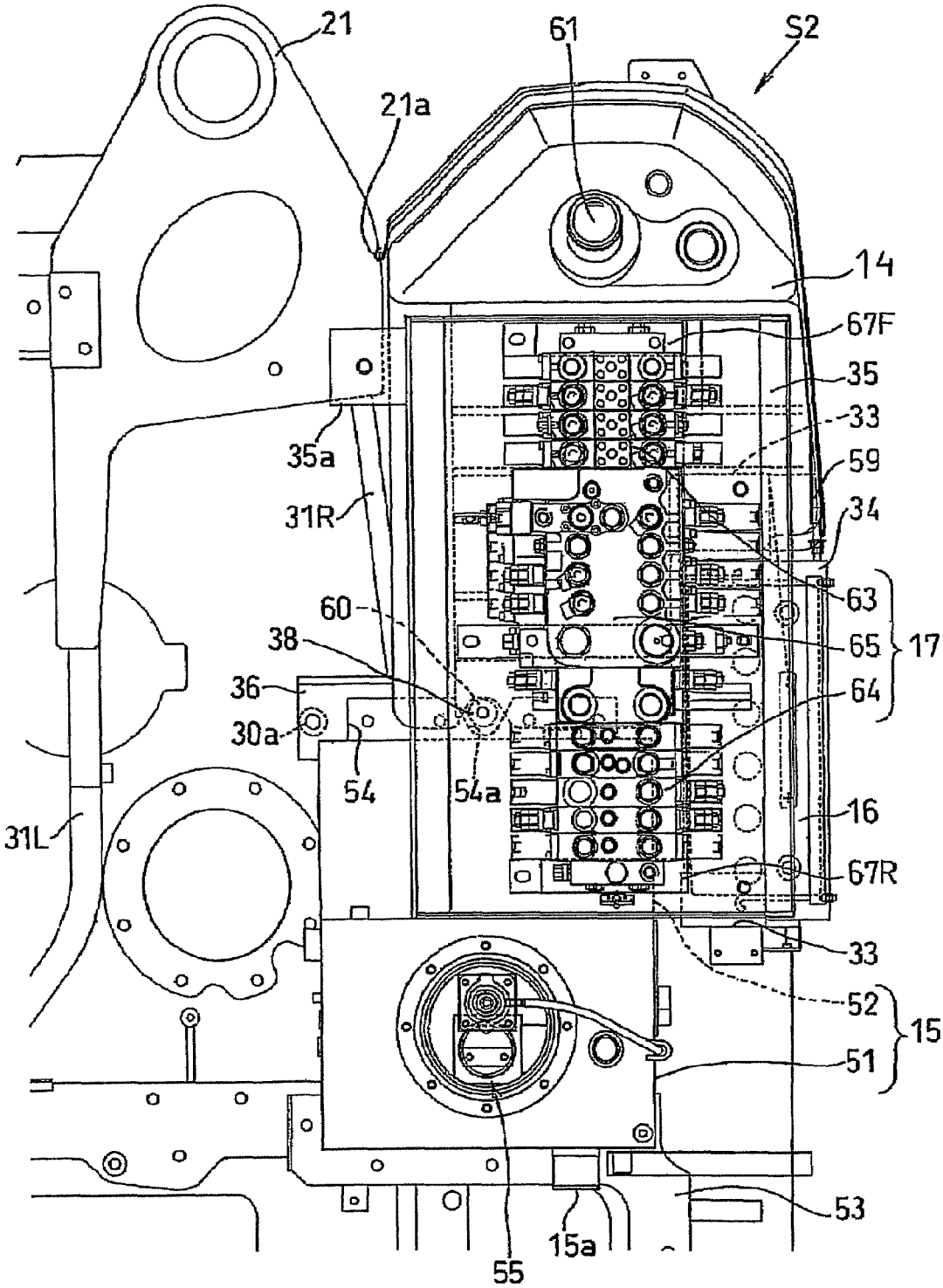
FIG. 6 is a plan view showing a layout of a control valve unit.

As shown in FIGS. 3 and 6, at an area forwardly of the radiator 12 and the oil cooler 12*a* which area is located inside the tank room S2, there is disposed the work oil tank 15 for reserving work oil to be fed to the dozer 5, the hydraulic cylinders, etc. Forwardly of this work oil tank 15, there is disposed the fuel tank 14 for reserving fuel to be supplied to the engine 11. At a gap formed between the fuel tank 14 and the work oil tank 15, there is disposed the battery 16 as an electricity supply source for the backhoe 1. And, upwardly of this battery 16, there is disposed the control valve unit 17 for controlling work oil to be supplied to the dozer 5, the hydraulic cylinders, etc.

As shown in FIG. 3, the work oil tank 15 includes a main body 51 which is a rectangular solid shape longitudinal in the vertical direction and an extension portion 52 formed by extending forwardly a front lower portion of the main body 51, so that the tank is L-shaped in its side view.

Further, the work oil tank 15 includes a rear bracket 53 at a rear portion of the bottom face of the main body 51 and a front bracket 54 at a front portion of the bottom face of the extension portion 52. The rear bracket 53 is supported to the right vertical rib 31R and another reinforcing member, and the front bracket 54 extends from the bottom face of the extension portion 52 of the work oil tank 15 to the upper face of the bridge 36 of the support frame 32.

Also, the front bracket 54, as shown in FIG. 5, includes, at a center portion thereof, a recess 54*a* which is curved from its front end to its rear end and is connected to the bridge 36 via a fastener, with the cylindrical member 38 of the support frame 32 being engaged in the recess 54*a*. Further, the upper end face of the main body 51 of the work oil tank 15 includes an oil filler opening 55.

As shown in FIG. 3, the fuel tank 14 is disposed forwardly of the work oil tank 15 and on the front edge of the swivel base plate 30. The fuel tank 14 includes a main body 56 occupying the space of the front portion of the tank room S2 from the outer side to the inner side of the swivel deck and an extension portion 57 extending from the rear upper portion of the main body 56 from the inner side to the rear side of the swivel deck. The main body 56 of the fuel tank 14, as shown in FIG. 3, includes, at a vertical intermediate portion thereof, a cross groove 58 extending from the front portion to the right portion. Within this cross groove 58, there is entrained a metal belt 59. One end of this belt 59 on the right side of the main body 56 is connected via a bracket to the support frame 32, while the other end of the belt 59 on the front side of the main body 56 is detachably retained to a retaining portion 21*a* of a support bracket 21 shown in FIG. 5.

Further, the extension portion 57 of the fuel tank 14 has its lateral side on the swivel deck outer side placed in opposition to the support frame 32 and has its rear end face placed in opposition to the front end face of the extension portion 52 of the work oil tank 15. Moreover, at a center of a rear end face of the extension portion 57 of the fuel tank 14, there is formed a vertical groove 60 in the form of a curved recess extending from an upper end to a lower end of this rear end face, and the cylindrical member 38 of the support frame 32 is fitted within this vertical groove 60.

Also, as shown in FIG. 3, the upper end face of the fuel tank 14 extends, from the main body 56 across the extension portion 57, substantially flush with the upper end face of the extension portion 52 of the work oil tank 15. Further, the upper end face of the main body 56 of the fuel tank 14 includes an oil filler opening 61.

The battery 16 is mounted on the first plate 34 of the support frame 32, with positive and negative electrodes thereof being located along the fore/aft direction of the swivel deck 7 and is attached to this first plate 34 via a pair of fore and aft fasteners. Further, the lateral face of the battery 16 on the swivel deck inner side is placed in opposition to the extension portion 51 of the work oil tank 15 and the extension portion 57 of the fuel tank 14.

The lateral face of the battery 16 on the swivel deck outer side, as shown in FIG. 7, is placed in opposition to the openable/closable cover member 46 under the latter's closed condition. Then, by setting this openable/closable cover member 46 to the opened condition, the battery 16 requiring frequent maintenance alone can be exposed for a maintenance thereof, with keeping the work oil tank 15 and the fuel tank 14 which require less frequent maintenance thereof covered with the front and rear fixed cover members 45, 47.

Further, as shown in FIG. 3, the upper portion of the battery 16 is covered with the second plate 35. Hence, although e.g. replacement of this battery 16 will be extremely difficult only by opening the cover lid 43, by setting the openable/closable cover member 46 to the opened condition, the lateral side of the battery 16 on the outer side of the swivel deck is exposed, whereby the battery 16 can be readily removed from the tank room S2 by releasing the pair of fasteners.

Looking at the layout of the above components, the work oil tank 15, the fuel tank 14 and the battery 16 from a different point of view, it may be understood that within the tank room S2, the work oil tank 15 is disposed at a rear portion of the tank room S2, the fuel tank 14 is disposed at a front portion of the tank room S2 and at the fore/aft intermediate portion of the tank room S between the work oil tank 15 and the fuel tank 14, there is formed the gap and on the swivel deck outer side of this space, the battery 16 is disposed and on the swivel deck inner side of the space, the extension portion 52 of the work oil tank 15 and the extension portion 57 of the fuel tank 14 are disposed.

Further, the second plate 35 of the support frame 32, as shown in FIG. 5, extends to the position upwardly of the main body 56 of the fuel tank 14 so as to cover the intermediate portion to the rear portion of the upper end face of the main body 51 of the fuel tank 14, the upper end face of the extension portion 57, the swivel deck inner side of the upper face of the battery 16, and the swivel deck outer side of the upper end face of the extension portion 52 of the work oil tank 15, and as shown in FIG. 6, the control valve unit 17 is disposed on the upper face of this second plate.

The control valve unit 17 includes a first block 63 and a second block 64 comprised of a plurality of valve members connected in series along the fore/aft direction and a valve body 65 which is formed larger in the vertical direction and the right/left direction than the two blocks 63, 64, with the valve body 65 being connected to a rear portion of the first block 63, the second block 64 being connected to a rear portion of the valve body 65.

Further, as shown in FIG. 3, the first block 63, the valve body 65 and the second block 64 are connected with the respective upper faces thereof being substantially flush with each other, and the valve body 65 being mounted on the second plate 35 via a filler 66 in the form of a flat plate. With this, a gap is formed between the bottom faces of the first block 63 and the second block 64 and the second plate 35. Further, at a front lower portion of the first block 63 and a rear lower portion of the second block 64, there are disposed attaching brackets 67F, 67R, respectively, with these attaching brackets 67F, 67R being connected to the second plate 35 via fasteners such as bolts.

In the assembly process for disposing the work oil tank 15, the fuel tank 14, the battery 16 and the control valve unit 17 within the tank room S2, first, the pair of stays 33, 33 interconnected via the first plate 34 will be fixed to the swivel base plate 31. Then, one end of the bridge 36 shown in FIG. 4 will be connected to the bracket 37 attached to the first plate 34 and the other end thereof will be connected to the boss-like member 21*a* and the cylindrical member 38 will be fastened to the center portion of the bridge 36.

Next, the rear portion of the bottom face of the main body 51 of the work oil tank 15 shown in FIG. 3 and FIG. 5 will be connected via the rear bracket 53 to the right vertical rib 31R disposed at the right side of the swivel base plate 30 and the front bracket 54 disposed at the front portion of the bottom face of the extension portion 52 of the work oil tank 15 will be connected to the bridge 36.

In the above, the bracket 54 is connected to the bridge 36 with the cylindrical member 38 being fitted within the recess 54*a*. With this, the work oil tank 15 will be disposed at the predetermined position at the rear region of the tank room S2 as being fixed in position through the engagement between the front bracket 54 and the cylindrical member 38.

Next, with fitting the vertical groove 60 of the extension portion 57 of the fuel tank 14 to the cylindrical member 38, the fuel tank 14 will be disposed at the front portion of the tank room S2. Then, the belt 59 shown in FIG. 3 will be entrained in the cross groove 58 of the main body 56 of the fuel tank 14 and one end of this belt 59 located on the right side of the swivel deck will be connected via the bracket to the front stay 33, whereas the other end of the belt 59 located on the front side of the swivel deck will be retained to the retaining member 21*a* of the support bracket 21. With this, the fuel tank 14 will be disposed at the predetermined portion at the front region of the tank room S2 as being fixed in position through the engagement between the vertical groove 60 and the cylindrical member 38.

Next, the battery 16 will be disposed on the first plate 34 and this battery 16 will be mounted on the first plate 34 via the pair of fore and aft fasteners. With this, the battery 16 will be disposed at the predetermined position on the swivel deck outer side of the gap formed in the tank room S2 between the work oil tank 15 and the fuel tank 14.

Then, the second plate 35 will be disposed so as to cover from the above the extension portion 51 of the work oil tank 15, the rear portion of the main body 56 of the fuel tank 14 and its extension portion 52 and the battery 16. And, this second plate 35 will be connected via the respective fasteners, to the pair of stays 33, 33, the rear end of the support bracket 21 and the cylindrical member 38. With this, the support frame 32 will be formed within the tank room S2.

Thereafter, with placing the front portion of the first block 63 of the control valve unit 17 in vertical opposition to the front portion of the second plate 35, the control value unit 17 will be mounted on the second plate 35, and then the pair of fore and aft attaching brackets 67F, 67R are connected to this second plate 35 via the fasteners such as the bolts. With this, the control valve unit 17 with the respective control valves thereof arranged along the fore/aft direction will be disposed at the predetermined position at the upper portion of the tank room S2 which is positioned upwardly of the extension portion 52 of the work oil tank 15, the battery 16 and the fuel tank 14.

In the case of the backhoe 1 relating to the instant embodiment, the main body 51 of the work oil tank 15 is disposed at a rear portion of the tank room S2 and the main body 57 of the fuel tank 14 is disposed at a front portion of the tank room S, namely, at the two positions as far as possible from each other in the tank room S2. And, at the gap formed between these components, i.e. the work oil tank 15 and the fuel tank 14, the battery 16 is disposed. Therefore, disadvantageous influence of heat from the work oil tank 15 to the fuel tank 14 is effectively restricted.

Further, in this embodiment, at the above gap, the extension portion 52 of the work oil tank 15 and the extension portion 57 of the fuel tank 14 are placed in opposition to each other. However, the area of this opposition is limited approximately to the area of the rear end face of the extension portion 57 of the fuel tank 14. Hence, with such limited area of mutual opposition, the fuel tank 14 will hardly be subjected to the influence of heat from the work oil tank 15. Rather, as the extension portions 52, 57 of the work oil tank 15 and the fuel tank 14 are provided in the gap, the capacities of the work oil tank 15 and the fuel tank 14 are enlarged without enlarging the capacity of the tank room S2. As a result, the tank room S2 is utilized even more efficiently.

Moreover, since the control valve unit 17 is disposed upwardly of the extension portion 52 of the work oil tank 15, the battery 16 and the fuel tank 14, then, by setting the cover lid 43 of the side cover 10 to its opened condition, the control valve unit 17 will be exposed in the vicinity of the edge of the opening of the side cover. With this, an operator can carry out maintenance of the control valve unit 17 under his/her stable posture (e.g. standing erect posture). Further, the oil filler openings 55, 61 of the work oil tank 15 and the fuel tank 14 are exposed in the vicinity of the opening edge. With this, by opening the cover lid 43, the operator can readily carry out oil feeding operation to the work oil tank 15 and to the fuel tank 14.

Further, as shown in FIG. 8, the cover lid 43 includes an oil filling cover 42*a* which is pivoted to be openable and closable at a position opposed to the oil filler opening 61 of the fuel tank 14. Then, by opening this oil filling cover 43*a*, also, the oil filling operation to the work oil tank 15 and the fuel tank 14 can be easily carried out.

The support frame 32 is connected, at the vertically intermediate portions of the pair of fore and aft stays 33, 33 shown in FIG. 3, to the first plate 34 and its upper ends are interconnected by the second plate 35 into the form of grating. Further, this support frame 32 is connected and supported at five positions, namely, to the connections between the pair of stays 33, 33 and the swivel base plate 30, the support bracket 21, the right vertical rib 31R and the boss-like member 31*a*. Hence, this frame 32 has high strength.

Further, under the first plate 34, there is reserved a space covered with the pair of stays 33, 33 and this first plate 34, so that various replacement components such as an oil filter, can be stored and housed within this space.

Also, since the second plate 35 is interposed between the control valve unit 17 and the extension portion 52 of the work oil tank 15 and between the battery 16 and the fuel tank 14, there will occur no splashing of oil to an area downwardly of the second plate 35 during the maintenance of the control valve unit. As a result, an oil cleaning operation during the maintenance of the control valve unit can be carried out easily.

Moreover, the undesirable influence of heat from the control valve unit 17 to the fuel tank 14 can be minimized also by means of the second plate 35.

Figure 9:
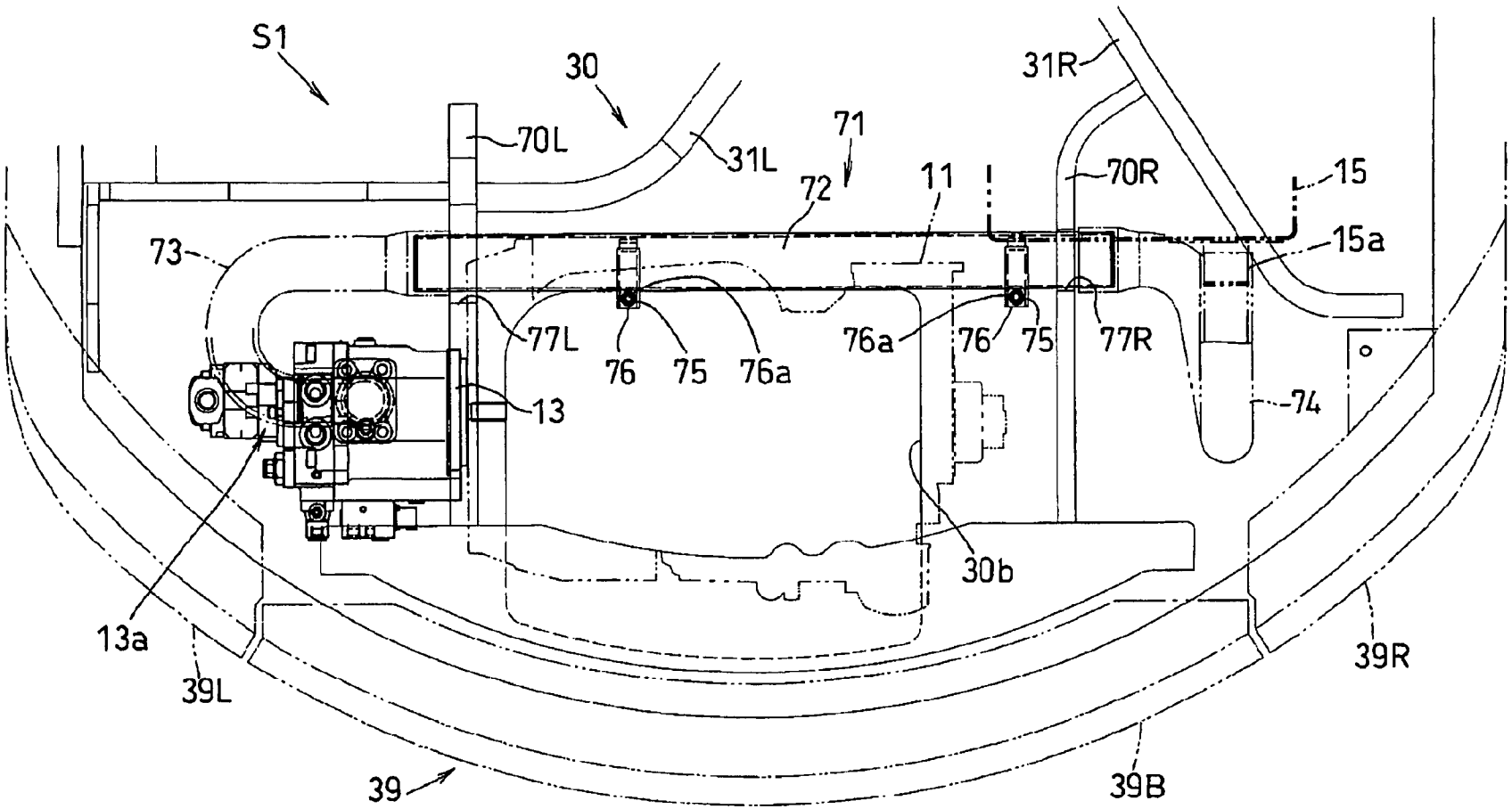
FIG. 9 is a plan view of an engine room.

Incidentally, as shown in FIG. 9, inside the engine room S1, a pair of left and right stays 70L, 70R project from the upper face of the swivel base plate 30 for supporting the engine 11 and a plurality of support members supporting the engine 11. The left stay 70L extends from the rear end of the left vertical rib 31L toward the rear portion of the swivel base plate 30, and the right stay 70R extends from a fore/aft rear intermediate portion of the right vertical rib 31L toward the rear portion of the swivel base plate 30 with its front end being slightly bent. And, the engine 11 is disposed at upper portions of the pair of left and right stays 70L, 70R. Also, the swivel base plate 30 defines an opening 30*b* at a position between the pair or left and right stays 70L, 70R and in opposition to the engine 11.

The counter weight 39 consists of a pair or left and right side protectors 39L, 39R covering opposed lateral sides of the engine room S1 and a rear weight 39B covering the rear portion of the engine room S1.

Figure 10:
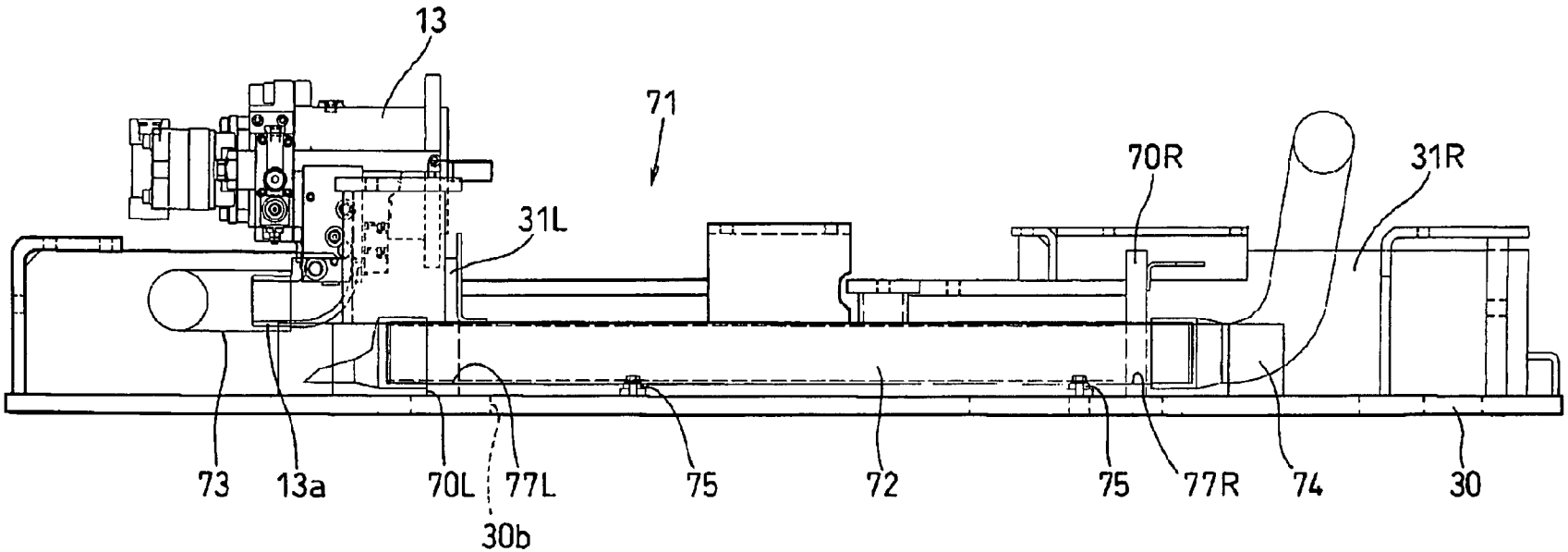
FIG. 10 is a rear view of the engine room.

Further, as shown in FIG. 9 and FIG. 10, forwardly and downwardly of the engine 11, there is provided a suction pipe portion 71 extending from the hydraulic pump 13 disposed on the left side of the engine to the right side of the engine 11. This suction pipe portion 71 consists of a section pipe 72 extending through forwardly and downwardly of the engine 11 along the right/left direction, a first hose 73 communicating a left end of the suction pipe 72 with an inlet 13*a* of the hydraulic pump 13 and a second hose 74 communicating a right end of the suction pipe 72 with a discharge outlet 15*a* of the work oil tank 15.

Figure 11:
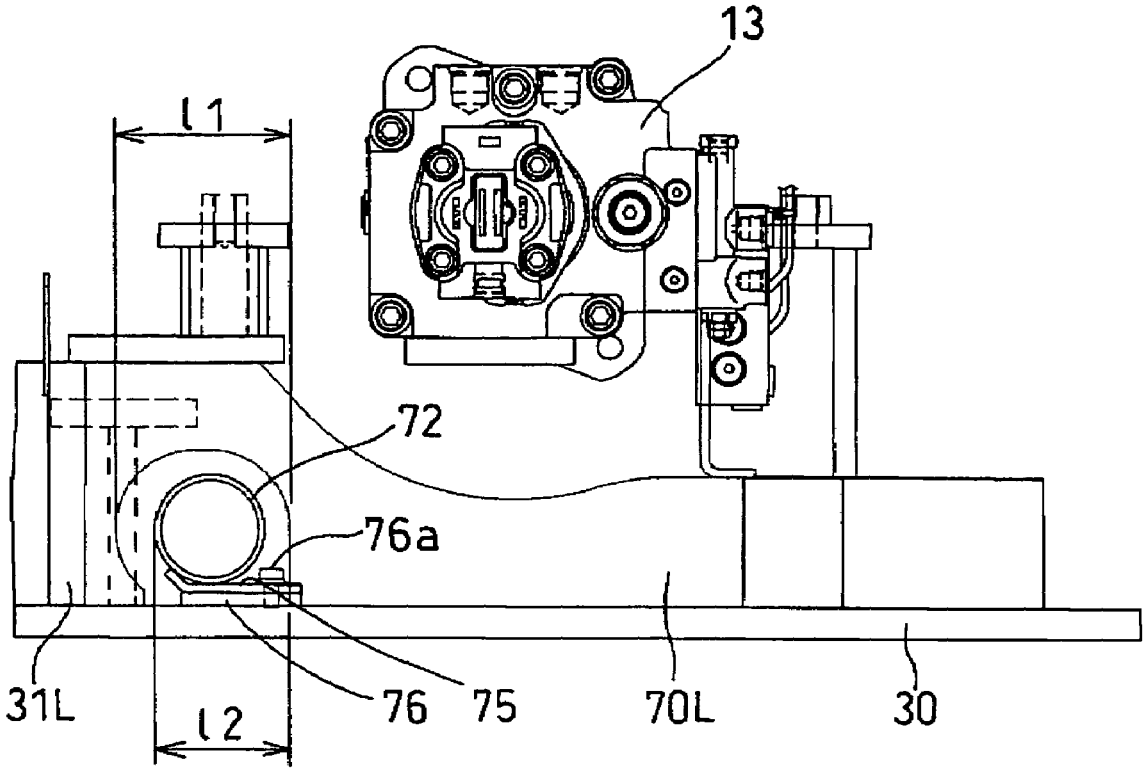
FIG. 11 is a left side view of the engine room.
Figure 12:
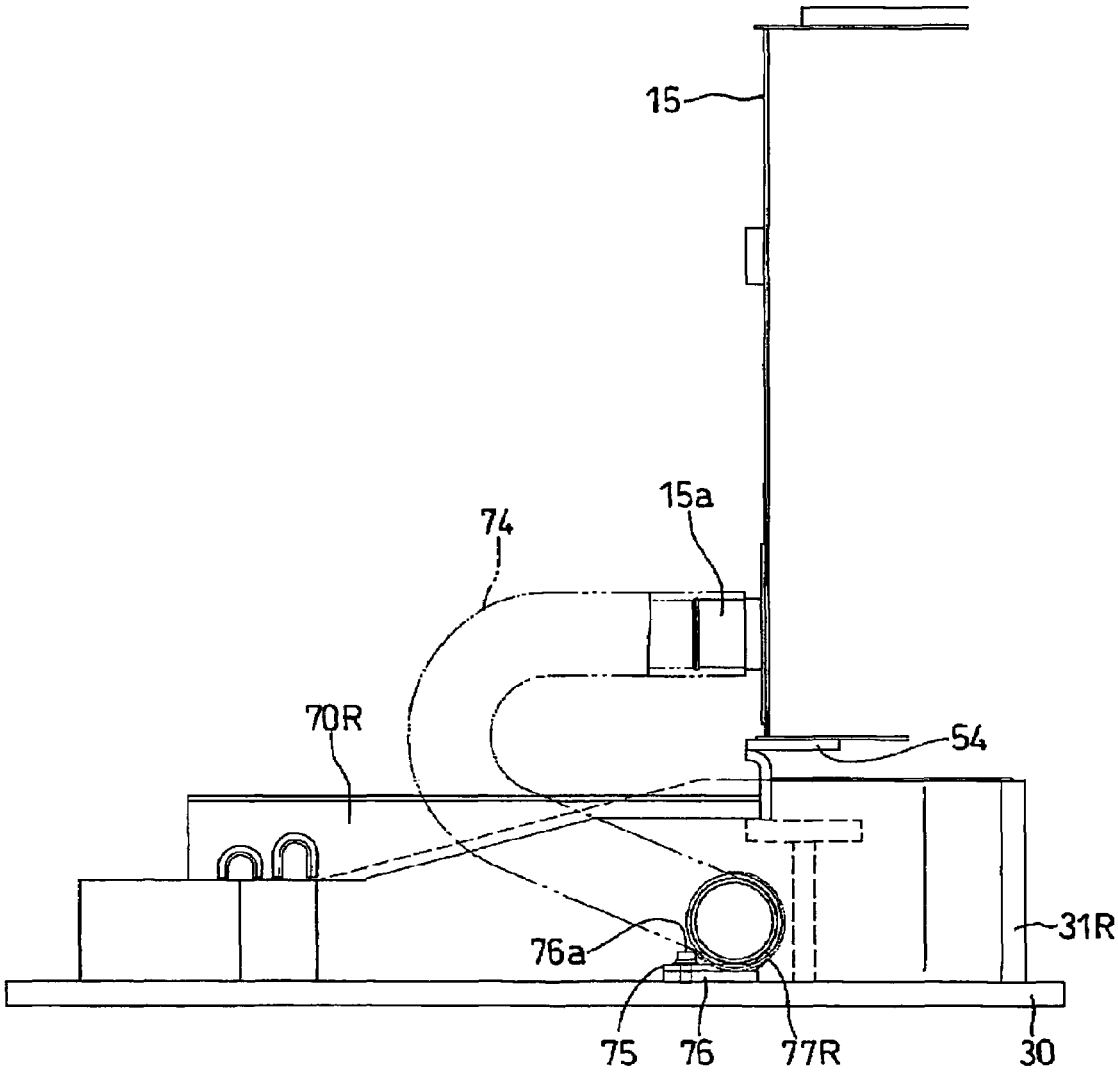
FIG. 12 is a right side view of the engine room.

As shown in FIGS. 10 through 12, the suction pipe 72 is constructed as a metal straight pipe and at a plurality of positions (two positions in this embodiment) in the midway of its extending direction, attaching pieces 75 for connecting this suction pipe 72 to the swivel base plate 30 are attached by means of e.g. welding.

Further, from the upper face of the swivel base plate 30 and in the vicinity of the opening 30*b*, attaching platforms 76 project for coming into contact with the attaching pieces 75 of the suction pipe 72 disposed at the predetermined position in the engine room S1, so that the attaching pieces 75 are connected to the upper faces of the attaching platforms 76 by means of fasteners 76*a* such as bolts.

Further, the suction pipe 72 is mounted as being inserted into a pair of insertion holes 77L, 77R formed respectively in mutually opposing faces of the left and right stays 70L, 70R.

Of the pair of insertion holes 77L, 77R described above, the insertion hole 77L formed in the left stay 70L has a maximum inter-peripheral edge distance 'λ1' which, as shown in FIG. 11, is greater than a length 'λ2' comprising a sum of an outer diameter of the suction pipe 72 and a projecting length of the attaching piece 75. On the other hand, the insertion hole 77R formed in the right stay 70R has a diameter which is only slightly greater than the outer diameter of the suction pipe 72, as shown in FIG. 12.

Further, the first and second hoses 73, 74, as shown in FIG. 9 and FIG. 10, comprise cylindrical members made of an elastic material such as rubber. The first hose 73 is bent at a cylindrical axis intermediate portion and communicates, under this condition, the left end of the suction pipe 72 with the inlet 13*a* of the hydraulic pump 13. Similarly, the second hose 74 is bent at a cylindrical axis intermediate portion and communicates, under this condition, the right end of the suction pipe 72 with the discharge outlet 15*a* of the work oil tank 15.

In the instant embodiment, in replacing the suction pipe portion 71, first, the pair of left and right side protectors 39L, 39R will be detached from the swivel base plate 31 for exposing the first and second hoses 73, 74 and then these first and second hoses 73, 74 will be detached. In this, as the two hoses 73, 74 are formed of elastic material and disposed at positions in opposition respectively to the protectors 39L, 39R, the detachment of the two hoses 73, 74 can be carried out easily.

Next, the fastener 76*a* will be released through the opening 30*b* of the swivel base plate 30 from under this swivel base plate 30. With this, the operator can release the coupling between the suction pipe 72 and the swivel base plate 30 without dismounting the engine 1.

And, the suction pipe 72 will be drawn out from the left side of the swivel base plate 30. In this, as the insertion hole 77L of the left stay 70L is so sized as to allow passage of the attaching pieces 75, the suction pipe 72 can be drawn out without being inferred with the swivel frame.

Therefore, according to the above-described construction, the suction pipe portion 71 can be detached without dismounting the engine 11. And, by effecting the above process in reverse order, the suction pipe portion 71 can be disposed at the predetermined position in the engine room S1 without dismounting the engine 11. Needless to say, it is also possible to replace one or both of the hoses 73, 74 by detaching one or both of the side protectors 39L, 39R.

The present invention has been described in details by way of its preferred embodiment. However, it is understood that the present invention is not limited to the construction of the foregoing embodiment. For instance, in the gap, only the front lower portion of the work oil tank 15 can be extended. Further, in this gap, only the rear upper portion of the fuel tank 14 can be extended. The control valve unit 17 can be of a conventional construction in which the control valves alone are arranged in one direction. Moreover, the first and second blocks 63, 64 of the control valve unit 17 can be mounted on the second plate 35 of the support frame 32.

Also, the backhoe 1 can be constructed alternatively as a super mini swivel type mounting the implement (e.g. excavator) 8 at the center of the upper face of the swivel body 3. The swivel body 3 and the components mounted thereon can be disposed in right/left reverse arrangement. The rear hood 40 of the hood 9 can be constructed as a sideway pivotable type.

Further, the seat 19 can be adapted to be position-adjustable in the fore/aft direction. Instead of the cabin 20 covering this seat 19, a driver's seat protecting unit having a ROPS (roll-over protection system) or canopy can be mounted behind the seat 19.

The invention claimed is:

1. A swiveling work machine comprising:

a swivel deck mounted to be pivotable about a vertical axis; and a side cover for covering one lateral side on the swivel deck, an accommodating space capable of accommodating a work machine accessory being provided inside said lateral cover;

wherein said accommodating space accommodates, as said implement accessory, a work oil tank, a fuel tank and a control valve unit; and said work oil tank is disposed at a fore-and-aft intermediate portion on one lateral side on said swivel deck, said fuel tank is disposed forwardly of said work oil tank forming a gap relative thereto, and said control valve unit is disposed upwardly of said fuel tank and longitudinally along the fore/aft direction.

2. The swiveling work machine according to claim 1, wherein said gap accommodates a battery therein, and said control valve unit is disposed upwardly of the battery and the fuel tank.

3. The swiveling work machine according to claim 2, wherein said battery and said control valve unit are supported to a support frame fixed to said swivel deck, and wherein said support frame includes a pair of stays disposed erect on an upper face of the swivel deck at positions forwardly and rearwardly of the battery, a first plate mounted between vertical intermediate portions of the pair of stays and mounting the battery thereon, and a second plate connected to upper ends of the pair of stays and mounting the control valve unit thereon.

4. The swiveling work machine according to claim 3, wherein a front portion of the second plate extends to a position upwardly of the fuel tank.

5. The swiveling work machine according to claim 2, wherein at least one of a front lower portion of the work oil tank and a rear portion of the fuel tank extends into a portion of said gap on an inner side of the swivel deck relative to the battery.

* * * * *